US008919395B2

(12) United States Patent
Green et al.

(10) Patent No.: US 8,919,395 B2
(45) Date of Patent: Dec. 30, 2014

(54) DISPENSING APPARATUS

(71) Applicants: Scott D. Green, Irondale, AL (US); Joseph M. Wyatt, Pinson, AL (US)

(72) Inventors: Scott D. Green, Irondale, AL (US); Joseph M. Wyatt, Pinson, AL (US)

( * ) Notice: Subject to any disclaimer, the term of this patent is extended or adjusted under 35 U.S.C. 154(b) by 51 days.

(21) Appl. No.: 13/895,535

(22) Filed: May 16, 2013

(65) Prior Publication Data

US 2014/0338788 A1 Nov. 20, 2014

(51) Int. Cl.
*B65B 1/04* (2006.01)
*B65D 50/00* (2006.01)

(52) U.S. Cl.
CPC ..... *B65D 50/00* (2013.01)
USPC ..... 141/372; 141/360; 141/362

(58) Field of Classification Search
USPC ..... 222/181.1, 153.13, 384, 321.7–321.9, 222/325, 251, 282, 287, 309; 141/346, 351, 141/369, 370, 372, 373, 360, 362
See application file for complete search history.

(56) References Cited

U.S. PATENT DOCUMENTS 1,521,928 A * 1/1925 Campbell ..... 53/268
1,635,159 A * 7/1927 Bergmann ..... 141/267
1,635,160 A * 7/1927 Bergmann ..... 141/267
1,989,575 A * 1/1935 Wandel ..... 141/360
3,370,750 A * 2/1968 Deatch ..... 222/30
3,698,453 A * 10/1972 Morane et al. ..... 141/349
3,822,032 A * 7/1974 Vergobbi ..... 222/55
6,568,438 B2 * 5/2003 Crossdale et al. ..... 141/104
7,104,467 B2 * 9/2006 Crossdale et al. ..... 239/302
7,588,062 B1 * 9/2009 Green ..... 141/362
7,818,946 B2 * 10/2010 Luechinger ..... 53/90
8,037,908 B1 * 10/2011 Green et al. ..... 141/284
8,230,888 B2 * 7/2012 Crossdale et al. ..... 141/18
8,640,742 B2 * 2/2014 Crossdale et al. ..... 141/2
2005/0133621 A1 * 6/2005 Crossdale et al. ..... 239/302
2009/0065092 A1 * 3/2009 Green et al. ..... 141/67

* cited by examiner

*Primary Examiner* — Paul R Durand
*Assistant Examiner* — Randall Gruby
(74) *Attorney, Agent, or Firm* — Bush Intellectual Property Law; Kenneth M. Bush

(57) ABSTRACT

A dispensing apparatus and method for dispensing flowable solid materials, wherein the apparatus includes a container for holding dispensable material, a dispensing assembly, a lever locking assembly, and a receptacle. In operation, a receptacle is inserted into a receptacle receiving area. The receptacle engages a pivotable release arm to unlock a latch plate. The receptacle also engages a pivotable latch arm to slide the latch plate to unblock a lever slot, thereby allowing a lever to be urged downward by a user. As the lever is urged downward, a piston advances through an angularly disposed piston shaft to push dispensable material from a piston shaft upper portion into a spiral chute wherein the material gravity flows down the chute and into the receptacle in the receptacle receiving area. The apparatus may include a receptacle locking assembly to lock the receptacle within the receptacle receiving area while material is being dispensed.

20 Claims, 17 Drawing Sheets

DISPENSING APPARATUS

FIELD OF THE INVENTION

The present invention relates to dispensers, and more particularly, to a dispensing apparatus and method for dispensing flowable solid materials.

BACKGROUND OF THE INVENTION

Dispensers for dispensing flowable solid materials into receptacles are known in the art. These dispensers can dispense food or non-food items, small particulate matter such as sand or powdered candy, or larger items such as nuts or small toys (e.g. marbles). Problems that can occur with dispensers include unauthorized dispensing of the material or improper closure of the dispensing mechanism following use, thus leading to leakage of material from the dispenser. What is needed is an improved dispensing apparatus that avoids unauthorized use and prevents product waste by ensuring proper closure of the dispensing mechanism.

SUMMARY OF THE INVENTION

The present invention is a dispensing apparatus and method for dispensing flowable solid materials. The invention preferably comprises a container for holding the dispensable material, a housing, a dispensing assembly, a lever locking assembly including a latch assembly and a release assembly, a receptacle locking assembly, and a receptacle. The housing preferably comprises a hopper in communication with the container, an angularly disposed piston shaft having an increased diameter upper portion in communication with the hopper, a spiral chute in communication with the piston shaft upper portion, a pivotable door mounted between the piston shaft and the chute, and a receptacle receiving area in communication with the chute. The dispensing assembly preferably comprises a pivotable lever having a first end operable by a user and movable within a vertically disposed lever slot, a piston mounted within the piston shaft wherein a lever second end is operably connected to the piston to linearly advance and retract the piston within the piston shaft, and a pivotable tensioning arm for engaging the lever second end to bias the lever second end downward. The latch assembly preferably comprises a latch arm pivotably biased into the receptacle receiving area, a slidable latch plate having an opening therein wherein the latch plate is operable to slidably block or unblock the lever slot, a first pivotable member operably connected to the latch arm and the latch plate, and a second pivotable member operably connected to the latch arm. The release assembly preferably comprises a release arm pivotably biased into the receptacle receiving area and a release pin operably connected to the release arm, wherein the release pin is operable to engage or disengage the latch plate opening. The receptacle locking assembly preferably comprises a cam member pivotably biased into the lever slot, a vertically disposed locking member pivotably attached to the cam member, a locking plate operable to slide into the receptacle receiving area, a first notch formed in the locking plate for receiving the latch arm second pivotable member therein, and a second notch formed in the locking plate for receiving a bottom end of the locking member. The receptacle preferably comprises an annular surface and an annular flange.

In operation, the receptacle is inserted into the receptacle receiving area. The receptacle annular flange engages the release arm and pivots the release arm out of the receptacle receiving area and thereby disengages the release pin from the latch plate opening. The receptacle annular surface engages the latch arm and pivots the latch arm out of the receptacle receiving area, thereby urging the latch arm first pivotable member to slide the latch plate to unblock the lever slot and urging the latch arm second pivotable member to slide the locking plate into the receptacle receiving area and thereby prevent the receptacle from being removed from the receiving area. The lever first end can now be urged downward by a user. As the lever first end is urged downward, the lever first end engages the cam member and pivots the cam member out of the lever slot and thereby urges the locking member bottom end into the second notch to prevent the locking plate from being removed from the receiving area. As the lever first end is urged downward, the lever second end engages the piston and advances the piston through the piston shaft to push the dispensable material from the piston shaft upper portion through the pivotable door and into the chute wherein the dispensable product gravity flows down the chute and into the receptacle in the receptacle receiving area.

Once the product has been fully dispensed, the lever first end can now be returned to its home position by being urged upward by the user and/or by action of the pivotable tensioning arm. As the lever first end is urged upward, the lever second end retracts the piston back through the piston shaft to allow additional product to gravity flow into the piston shaft upper portion. As the lever first end is urged upward, the lever first end disengages from the cam member to allow the cam member to pivot into the lever slot and thereby urge the locking member bottom end out of the second notch. The receptacle can now be removed from the receptacle receiving area. As the receptacle is removed, the receptacle annular surface disengages from the latch arm to allow the latch arm to pivot into the receptacle receiving area, thereby urging the first pivotable member to slide the latch plate to block the lever slot and urging the second pivotable member to slide the locking plate out of the receptacle receiving area. The receptacle annular flange disengages from the release arm to allow the release arm to pivot into the receptacle receiving area, thereby urging the release pin into the latch plate opening.

These and other features of the invention will become apparent from the following detailed description of the invention.

DETAILED DESCRIPTION OF THE INVENTION

Figure 1:
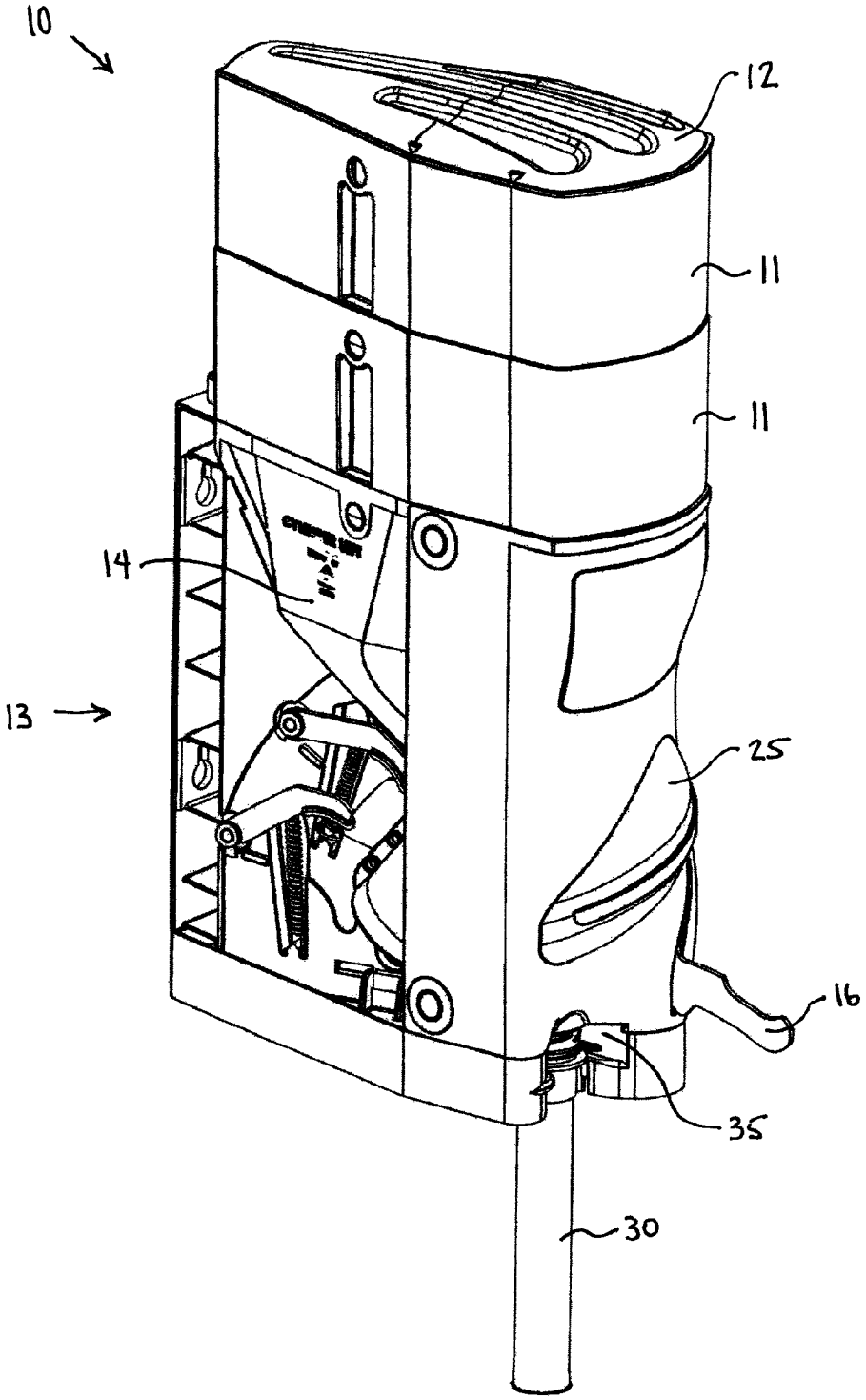
FIG. 1 is a left side perspective view of the dispensing apparatus.
Figure 2:
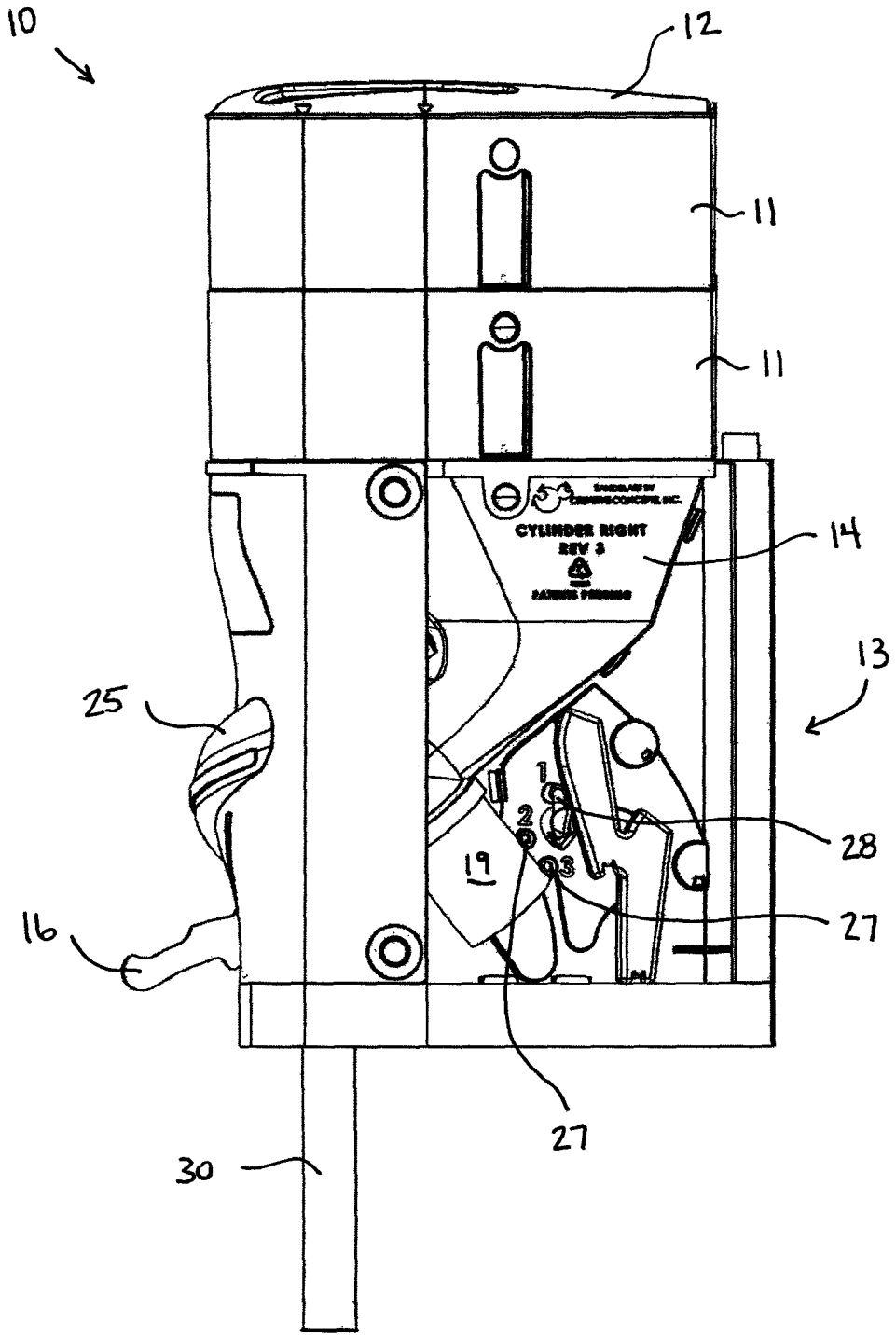
FIG. 2 is a right side elevation view of the dispensing apparatus.
Figure 3:
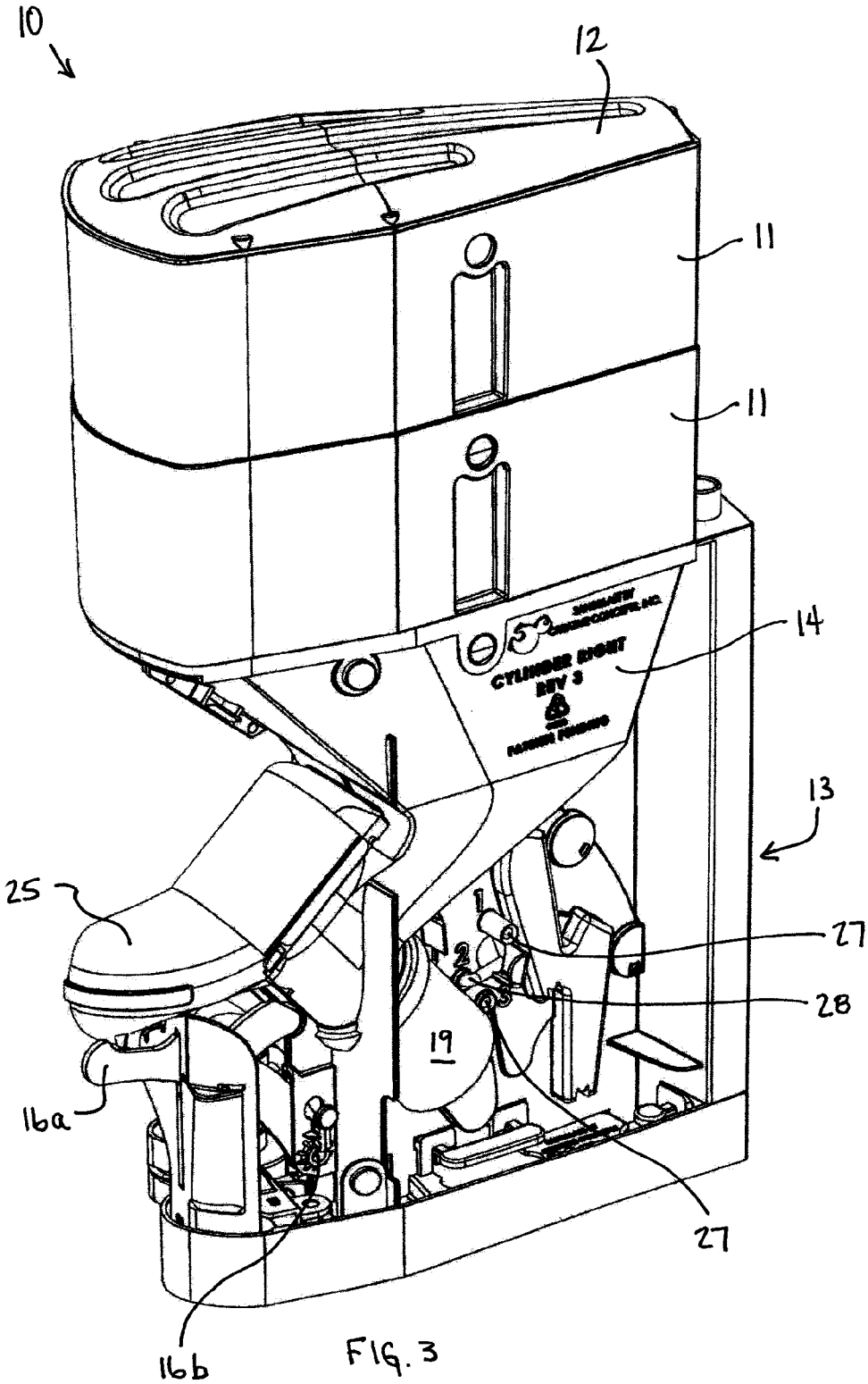
FIG. 3 is a right side perspective view of the dispensing apparatus with the front cover panel removed.
Figure 4:
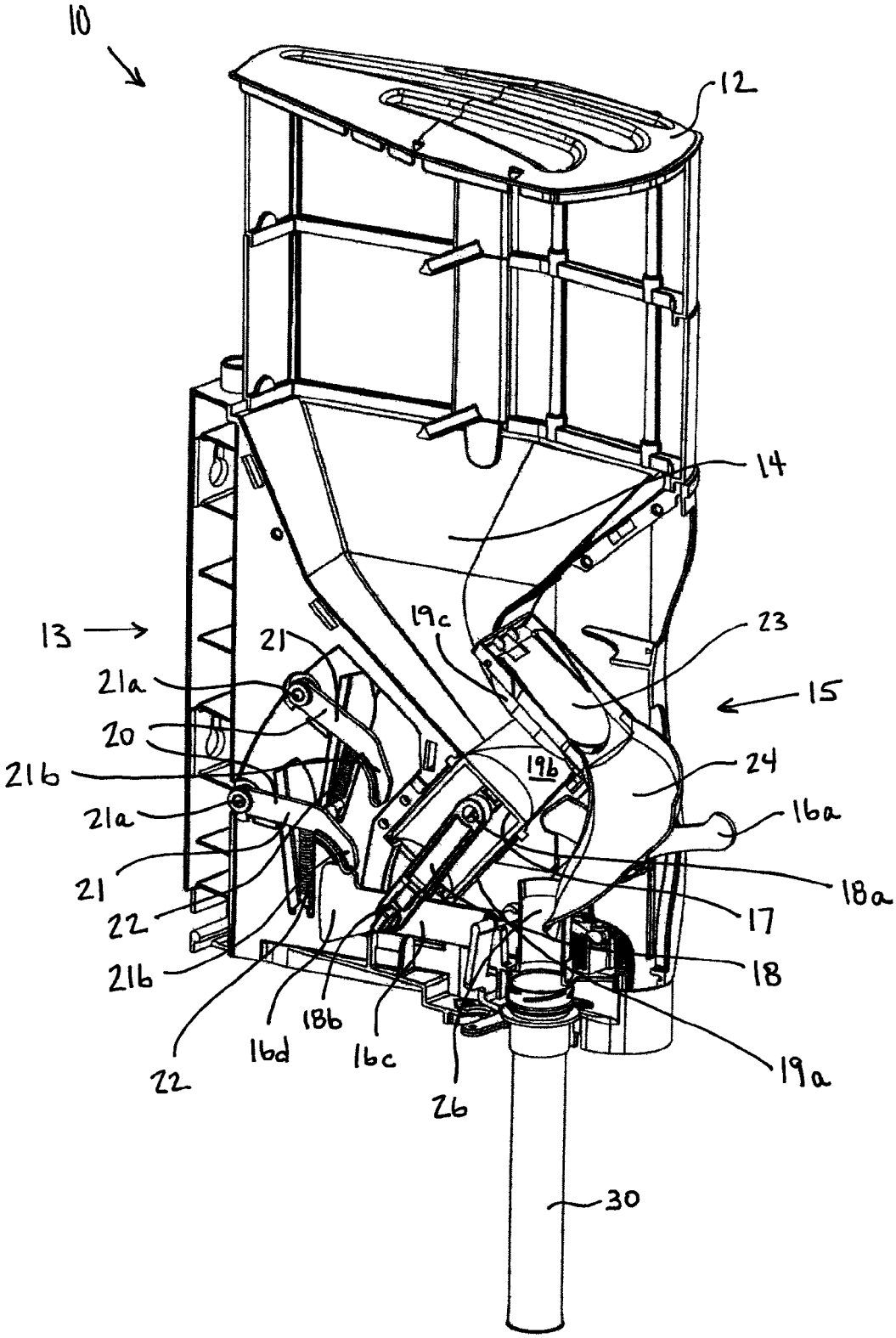
FIG. 4 is a front left cut-away view of the dispensing apparatus.

While the following description details the preferred embodiment of the present invention, it is to be understood that the invention is not limited in its application to the details of construction and arrangement of the parts illustrated in the accompanying drawings and described herein, since the invention is capable of other embodiments and of being practiced in other ways. Various changes in the details, materials, and arrangements of the parts which have been described and illustrated herein in order to explain the nature of this invention may be made by those skilled in the art without departing from the principle and scope of the invention.

The present invention, shown in FIGS. 1-17, is a dispensing apparatus 10 comprising one or more stackable containers 11 for holding a flowable solid material ("dispensable product"), a lid 12 to cover the top opening of the uppermost container 11, and a dispenser housing 13. The dispensing apparatus 10 further comprises a hopper 14 that gravity feeds the dispensable product into a dispensing assembly 15. The dispensing assembly 15 comprises a movable lever 16 having a first end 16*a* operable by a user, a fixed pivot point 16*b*, and a second end 16*c* having a distal tip 16*d*. The dispensing assembly 15 further comprises a piston 17 and a connecting rod 18 having a first end 18*a* pivotably connected to the piston 17 and a second end 18*b* pivotably connected to the lever second end 16*c*. The piston 17 is mounted for linear movement within a piston shaft 19 in an upward angular direction. The piston shaft 19 preferably has a lower portion 19*a* having a diameter slightly larger than the diameter of the piston 17 and an upper portion 19*b* including an upper end 19*c* wherein the upper portion 19*b* and upper end 19*c* have a greater diameter than the piston 17 and the lower portion 19*a* to prevent packing or blockage of the dispensable product as it is pushed out of the piston shaft 19 by the piston 17. The piston shaft upper portion 19*b* is open to the hopper 14 so that the dispensable product accumulates in the piston shaft upper portion 19*b*.

The dispensing assembly 15 further comprises one or more tensioning assemblies 20, wherein each tensioning assembly 20 preferably comprises a tensioning arm 21 having a first end 21*a* pivotably connected to the housing 13 and a movable second end 21*b*. A spring 22 biases the tensioning arm second end 21*b* toward a lowered position. The dispensing assembly 15 further comprises a material flow control door 23 pivotably mounted over the piston shaft upper end 19*c* wherein the door is biased to a closed position, a material flow chute 24, a chute cover 25, and a material flow receptacle shaft 26. The chute 24 is preferably spiral shaped to promote channeling of the dispensable product into the receptacle shaft 26. The spiral shape promotes outward spinning of the dispensable product as it gravity flows down the chute 24 such that the product becomes somewhat aligned, thereby promoting dispensing of the product into receptacles having small openings. This is an important feature inasmuch as if the same amount of product were to be dispensed directly into a standard funnel shaped mechanism, it would tend to bridge at the opening and block the dispenser. The chute cover 25 is preferably transparent so that a user can visually observe the dispensable product flowing down the chute 24. The housing 13 preferably has a plurality of apertures 27 through which a limit pin 28 can be inserted to limit the distance that the lever second end 16*c* can travel and thereby limit the travel distance of the piston 17 and the amount of dispensable product that can be dispensed per each lever action.

The dispensing apparatus 10 further comprises a locking assembly that includes a lever locking assembly 40 for controlling movement of the lever 16 and a receptacle locking assembly 60 that secures a product receptacle 30 to the housing 13 while product is being dispensed therein. The product receptacle 30 preferably comprises a tubular container 31 having a top cap 32 wherein the cap 32 has an annular surface 33 and an annular flange 34. Other shapes of receptacles can be used; however, it is important that they include features capable of operably engaging the locking assembly as described hereinbelow. The housing 13 has a receptacle receiving area 35 that includes a first slot 36, a second slot 37, and a third slot 38.

The lever locking assembly 40 comprises a pivotable latch arm 41 having a first end 41*a* pivotably attached to the housing 13 and a second end 41*b* that extends into the receptacle receiving area 35 through slot 36, a latch arm spring 42 that biases the latch arm second end 41*b* through the first slot 36, a first latch arm pivot member 43 operably connected to a pivotable rod 44 having a vertically disposed latch spring 45 secured thereto, and a second latch arm pivot member 46. The latch spring 45 has a first end 45*a* attached to the pivotable rod 44 and a second end 45*b* attached to a horizontally slidable latch plate 47 having a slot 48 therein. The latch plate 47 slidably engages a vertical lever slot 49 such that the latch plate 47 is operable to block the lever slot 49.

The lever locking assembly 40 further comprises a pivotable release arm 50. The release arm 50 has a first member 51 that extends into the receptacle receiving area 35 through slot 37, a pivot rod 52 pivotably attached to the housing 13, a second member 53 attached at a first end 53*a* to the pivot rod 52 and at a second end 53*b* to a latch plate release pin 54. A vertically disposed release arm spring 55 biases the second end 53*b* upward so that the release pin 54 is biased upward to engage the slot 48 in the latch plate 47.

The receptacle locking assembly 60 comprises a horizontally slidable locking plate 61 having a locking tab 62 that is operable to extend into the receptacle receiving area 35 through slot 38, a first slot 63 for receiving the second latch arm pivot member 46, and a second slot 64 for receiving a locking member second end 66*b*. The receptacle locking assembly 60 further comprises a vertically slidable locking member 66 having a first end 66*a* and a second end 66*b*. The locking assembly 60 further comprises a cam member 65 pivotably connected at a first end 65*a* to the housing 13 and at a second end 65*b* to the locking member first end 66*a*. A cam spring 67 biases the cam member 65 into the lever slot 49.

In operation, a user inserts the product receptacle 30 into the receptacle receiving area 35 of the housing 13 to start the product dispensing process, best shown in FIGS. 11-15. As the receptacle 30 is completely inserted within the receiving area 35, a number of processes take place that collectively (1) release the lever first end 16*a* so that it can be pulled down to dispense product from the dispensing apparatus 10 into the product receptacle 30, and (2) lock the product receptacle 30 within the receiving area 35 until the lever first end 16*a* is returned to its raised home position.

As the product receptacle 30 is completely inserted within the receiving area 35, the receptacle annular surface 33 engages the latch arm 41 and the receptacle annular flange 34 engages the release arm first member 51. Release pin 54 is initially engaged within slot 48 of latch plate 47 to prevent latch plate 47 from sliding out of lever slot 49, best shown in FIGS. 8-9 and 11-12. As the annular flange 34 engages the release arm first member 51, the release arm first member 51 pivots out of slot 37 and pivot rod 52 pivots release arm second member 53 downward so that release pin 54 is pulled out of slot 48, thereby releasing latch plate 47 so that latch plate 47 can slide out of lever slot 49, best shown in FIGS. 13-17. As the annular surface 33 engages the latch arm 41, the latch arm second end 41*b* pivots out of slot 36 and first pivot member 43 actuates pivot rod 44 to rotate counterclockwise, which thereby actuates latch spring 45 to place tension on latch plate 47 to slide latch plate 47 out of lever slot 49 when release pin 54 is pulled out of slot 48, best shown in FIGS. 14-16. As the latch arm second end 41*b* pivots out of slot 36, second pivot member 46 actuates locking slide plate 61 to slide toward receptacle receiving area 35 so that locking tab 62 extends through slot 38 into receiving area 35 to prevent product receptacle 30 from being removed from receiving area 35, best shown in FIGS. 14-16.

Figure 15:
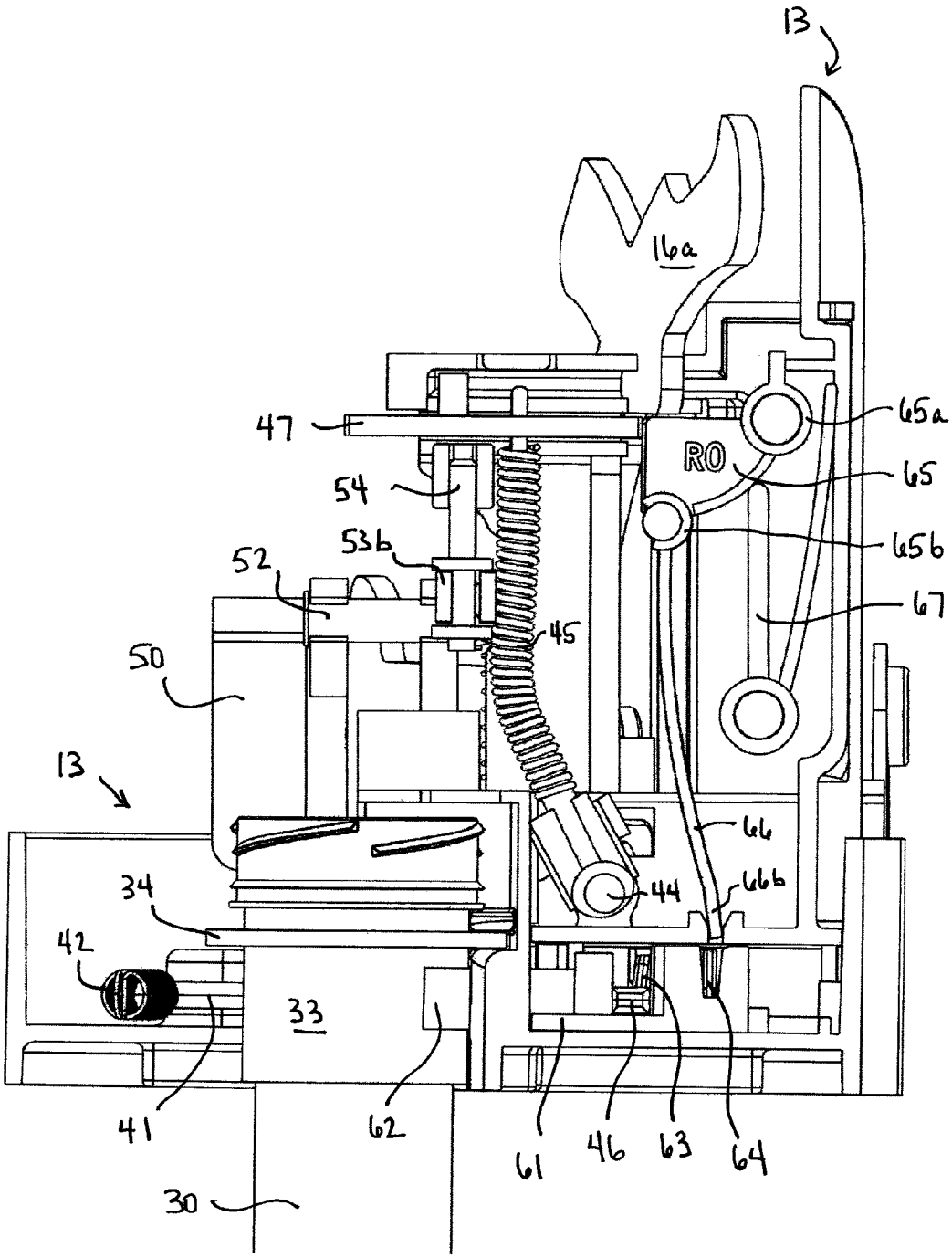
FIG. 15 is a front cut-away view of the dispensing apparatus showing portions of the dispensing assembly and the locking assembly after complete insertion of the product receptacle.
Figure 16:
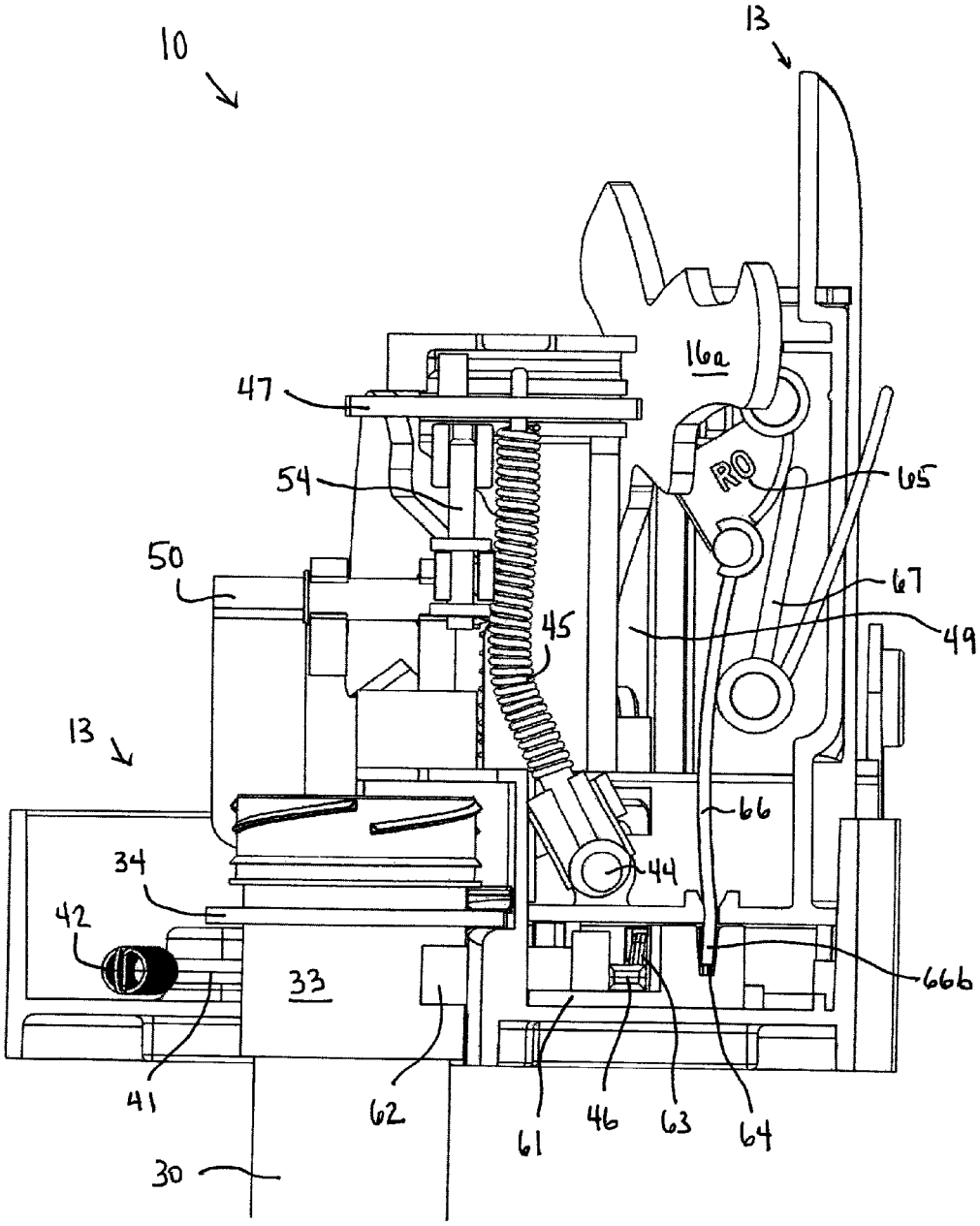
FIG. 16 is a front cut-away view of the dispensing apparatus showing portions of the dispensing assembly and the locking assembly after complete insertion of the product receptacle and initial lowering of the dispensing lever.
Figure 17:
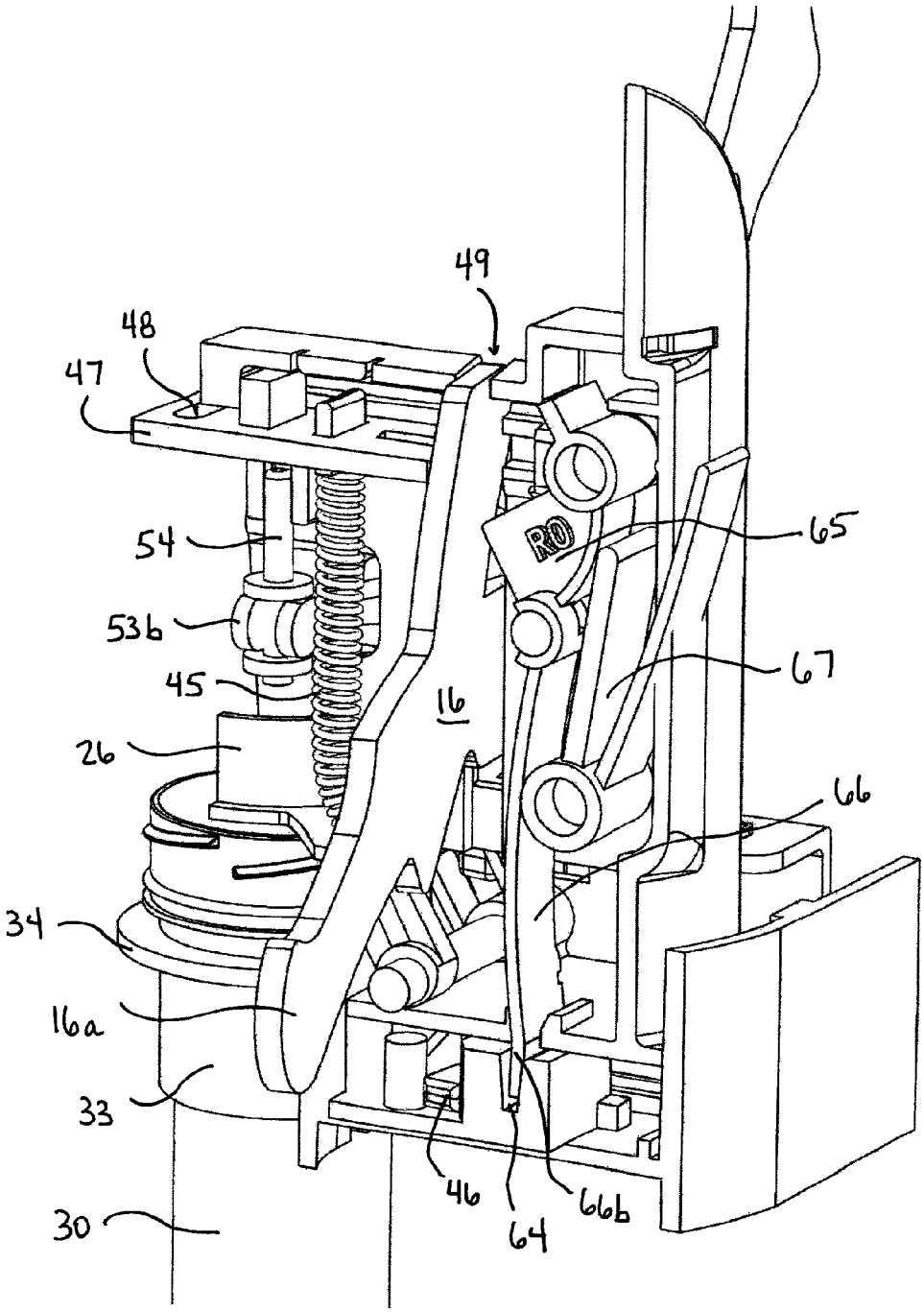
FIG. 17 is a front right cut-away view of the dispensing apparatus showing portions of the dispensing assembly and the locking assembly after complete insertion of the product receptacle and complete lowering of the dispensing lever.

With latch plate 47 out of lever slot 49, lever first end 16*a* can be pulled downward, best shown in FIGS. 15-17. As lever first end 16*a* is pulled downward through lever slot 49, it engages cam 65 which pivots downward and thereby actuates slide lock 66 to move downward so that slide lock second end 66*b* enters slot 64 to prevent slide plate 61 from moving and thus locking tab 62 from being removed from receptacle receiving area 35, best shown in FIGS. 16-17.

Figure 5:
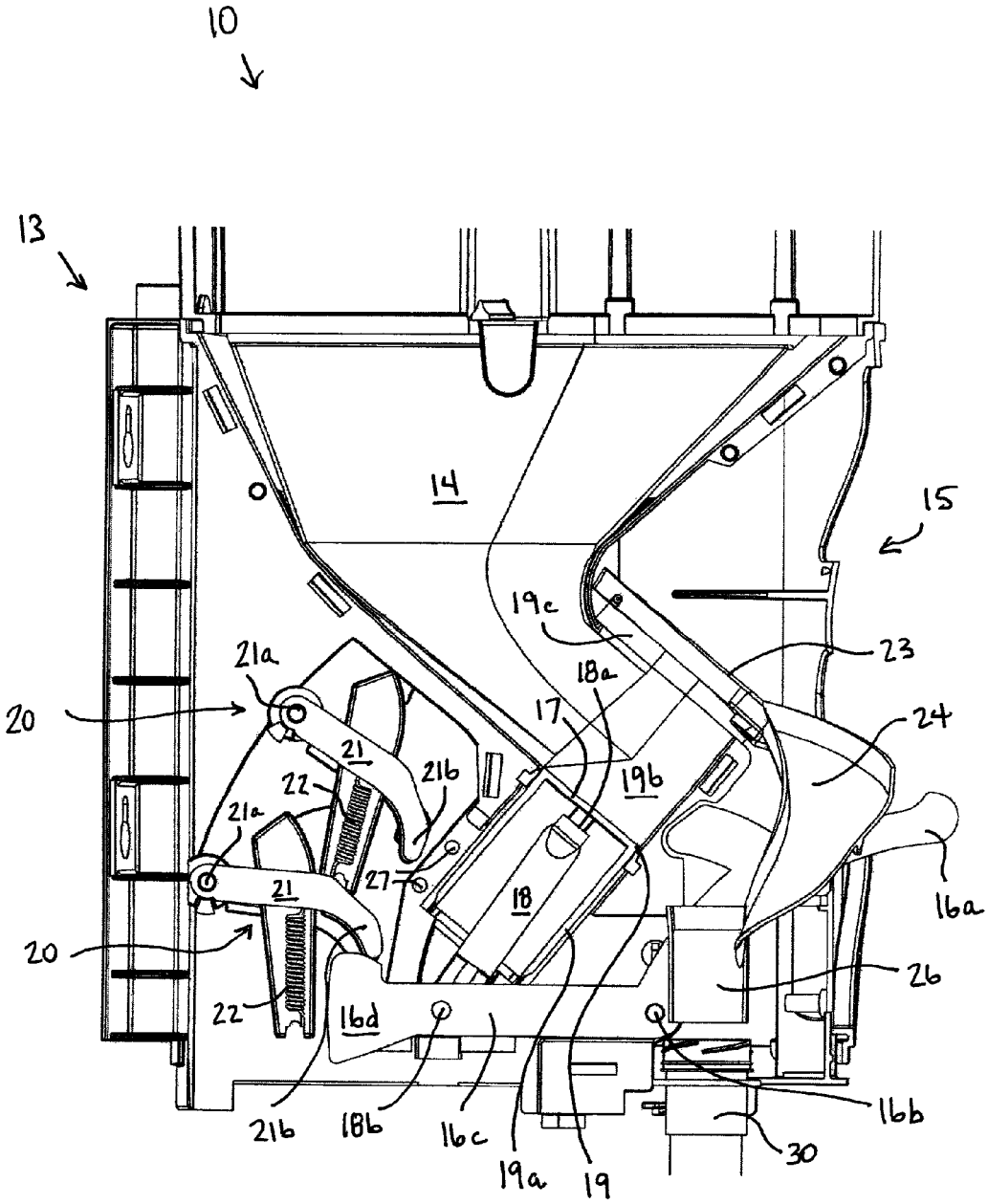
FIG. 5 is a left side cut-away view of the dispensing apparatus showing the dispensing assembly prior to product dispensing.
Figure 6:
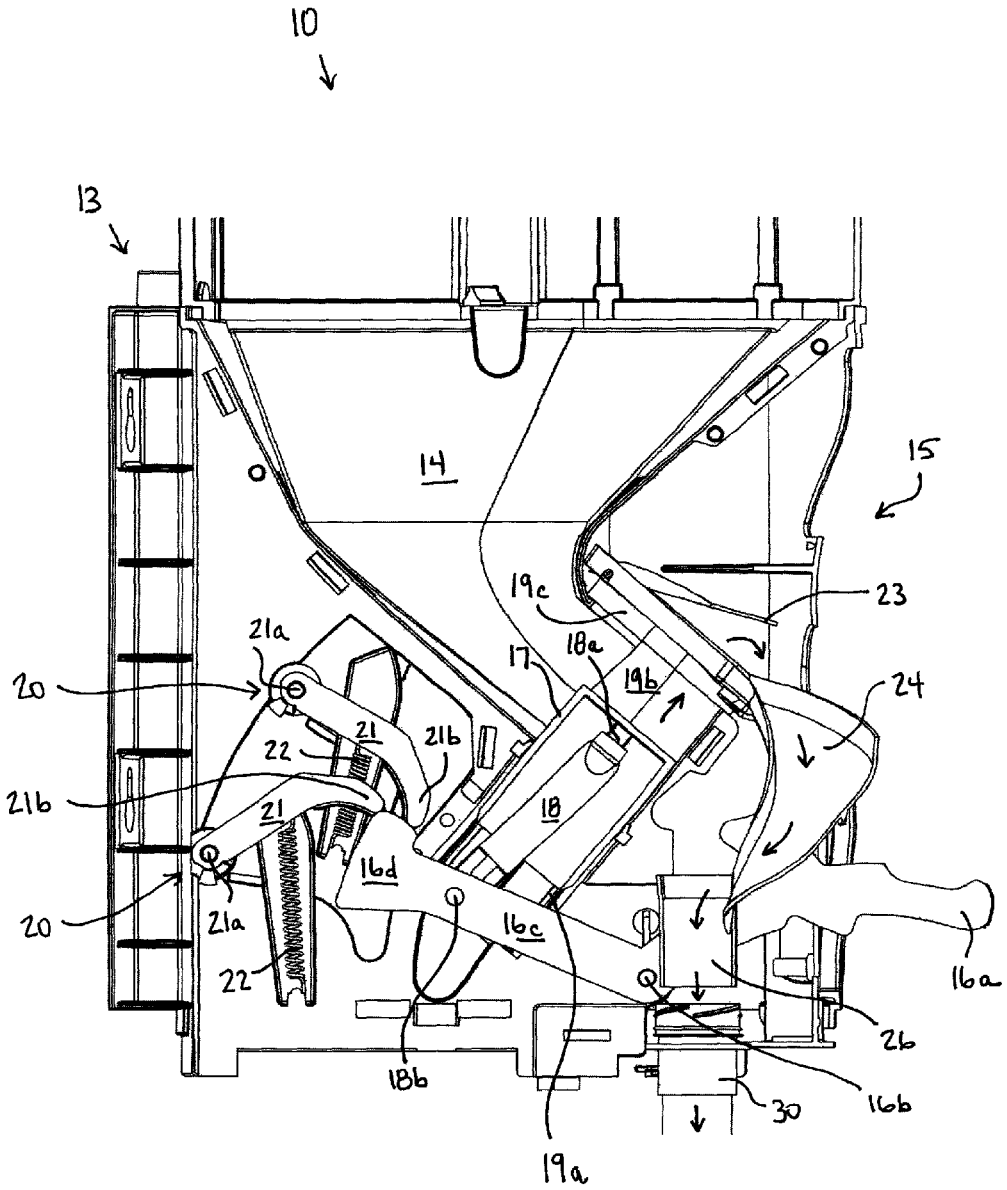
FIG. 6 is a left side cut-away view of the dispensing apparatus showing the dispensing assembly dispensing product.
Figure 7:
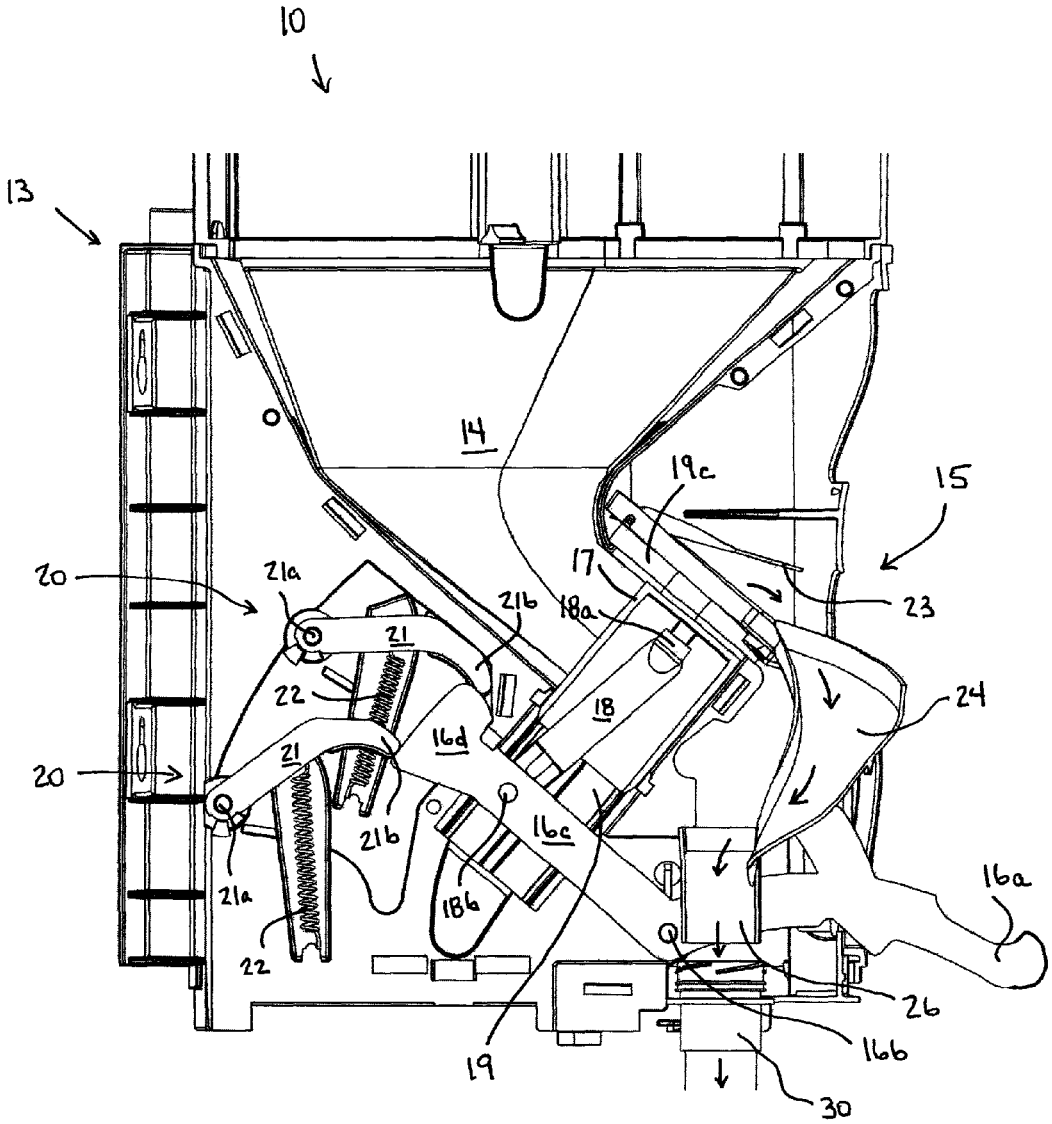
FIG. 7 is a left side cut-away view of the dispensing apparatus showing the dispensing assembly dispensing product.
Figure 8:
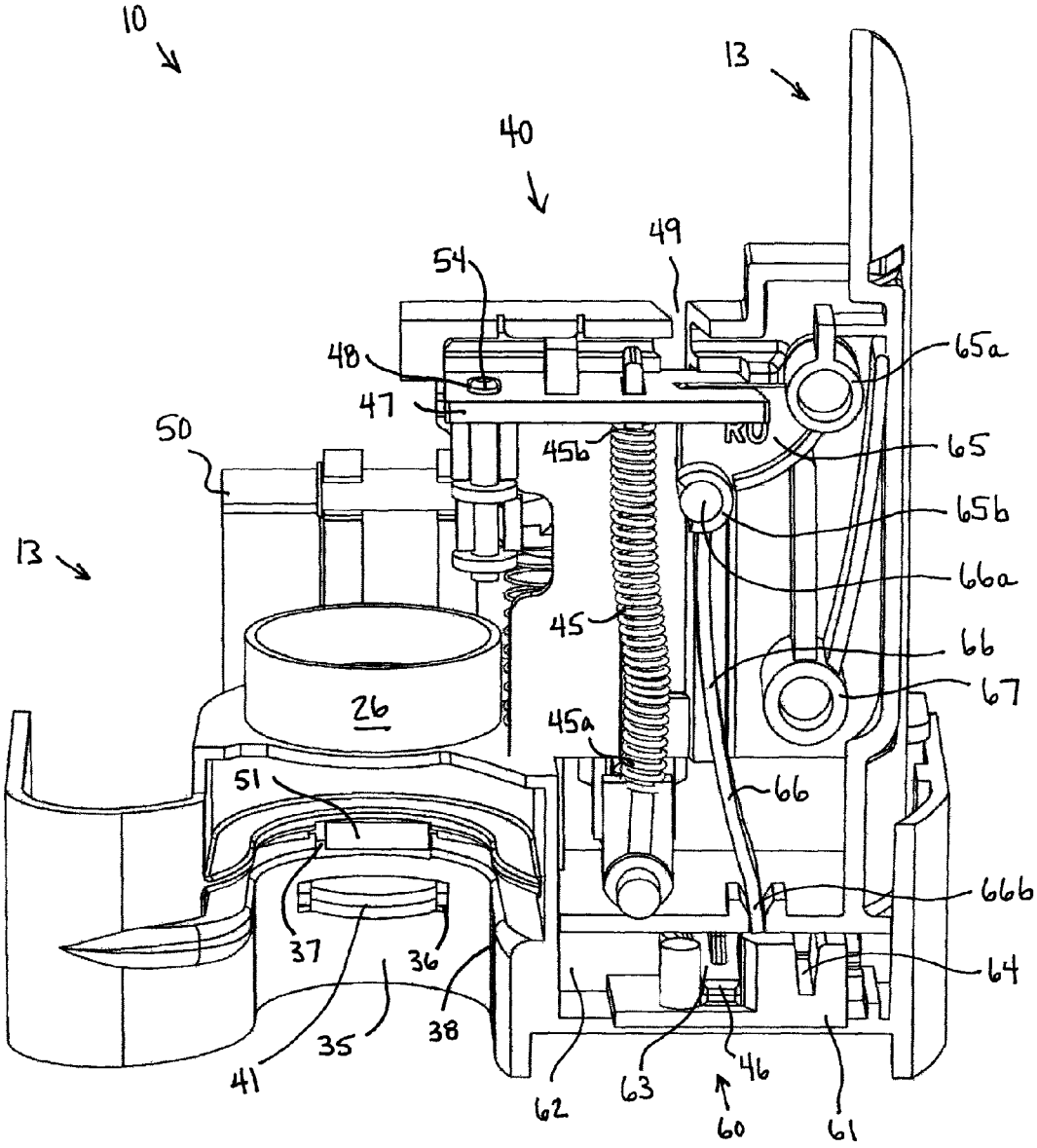
FIG. 8 is a front cut-away view of the dispensing apparatus showing portions of the dispensing assembly and the locking assembly.
Figure 9:
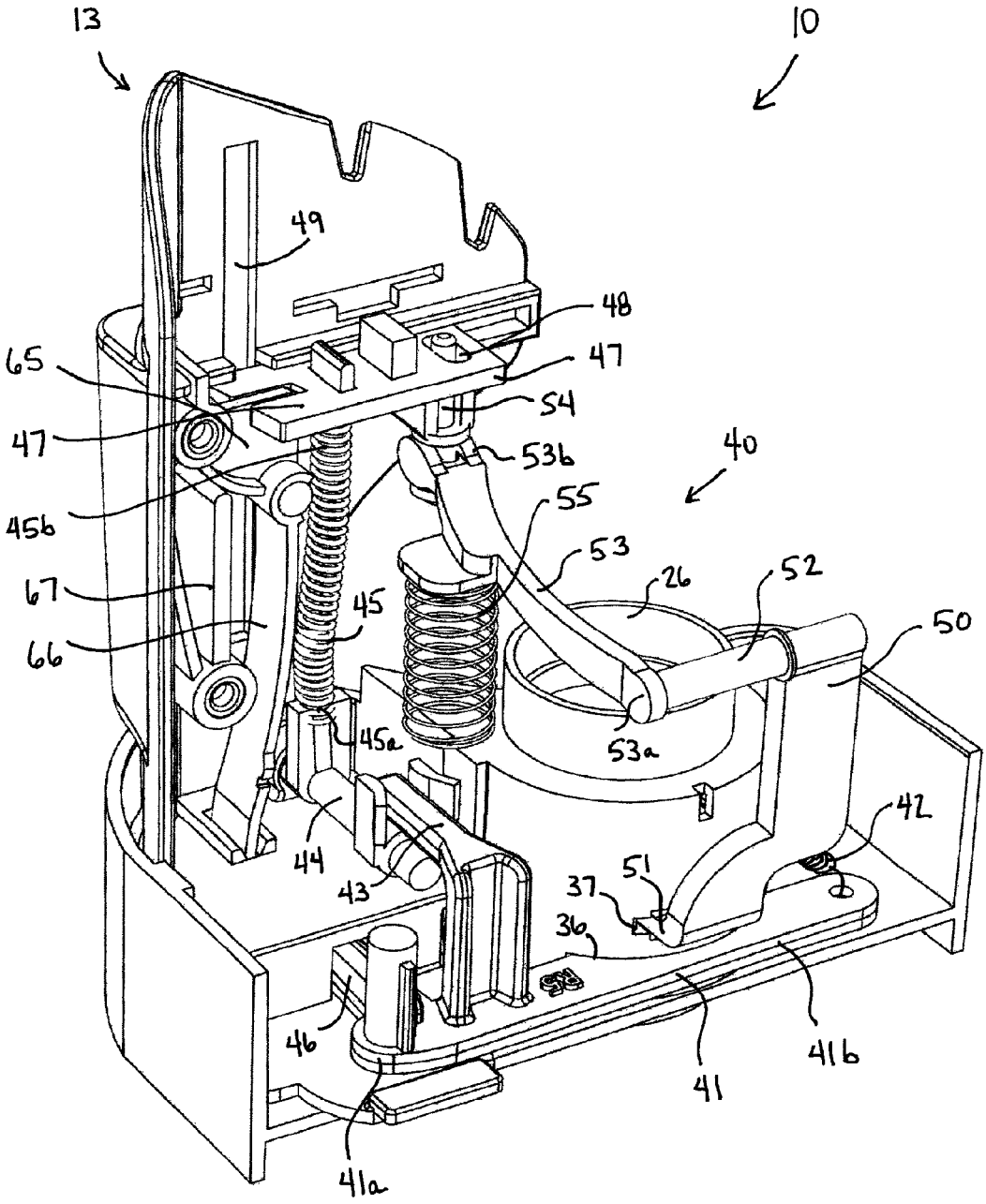
FIG. 9 is a right rear cut-away view of the dispensing apparatus showing portions of the dispensing assembly and the locking assembly.
Figure 10:
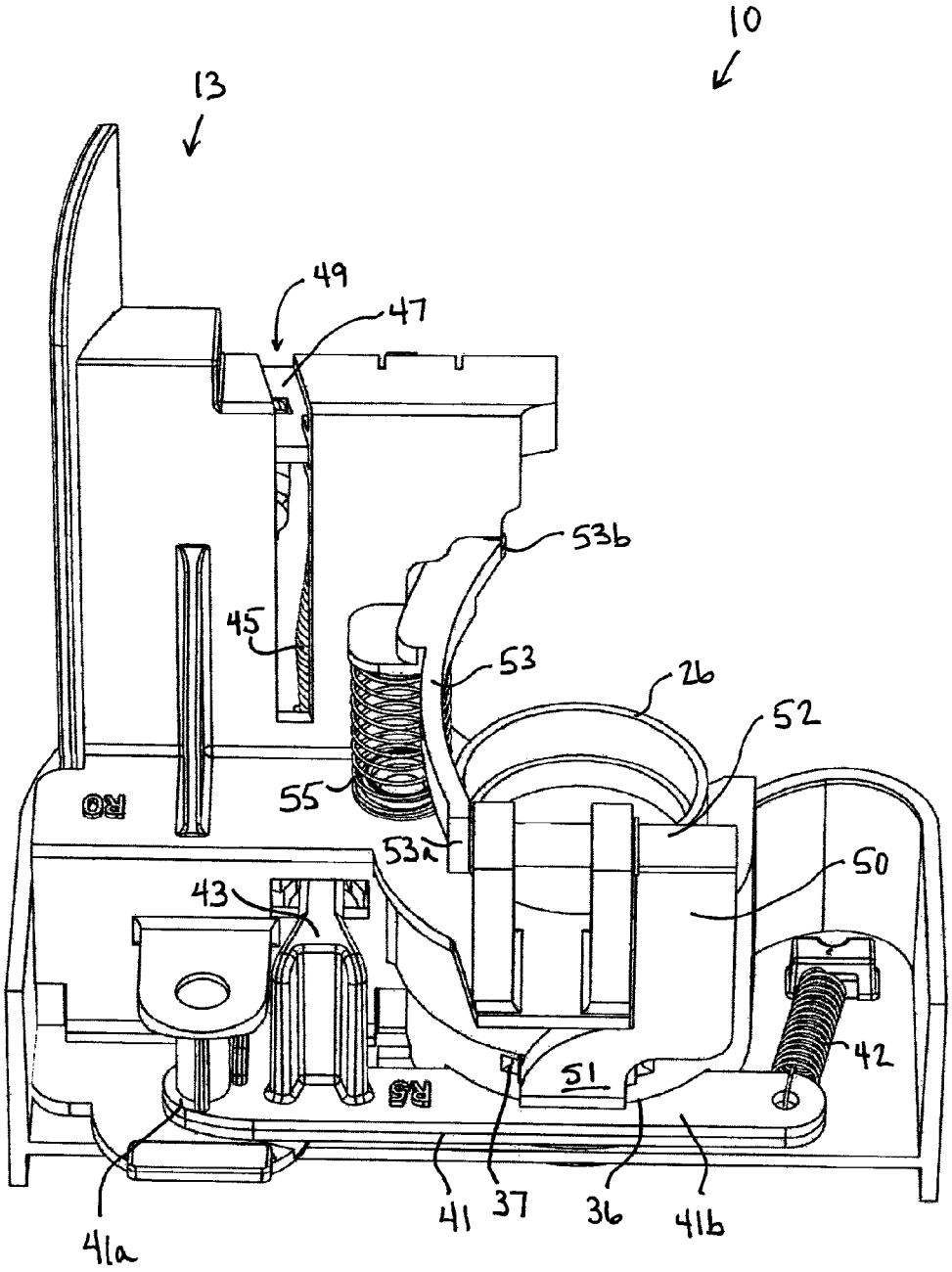
FIG. 10 is a rear cut-away view of the dispensing apparatus showing portions of the dispensing assembly and the locking assembly.
Figure 11:
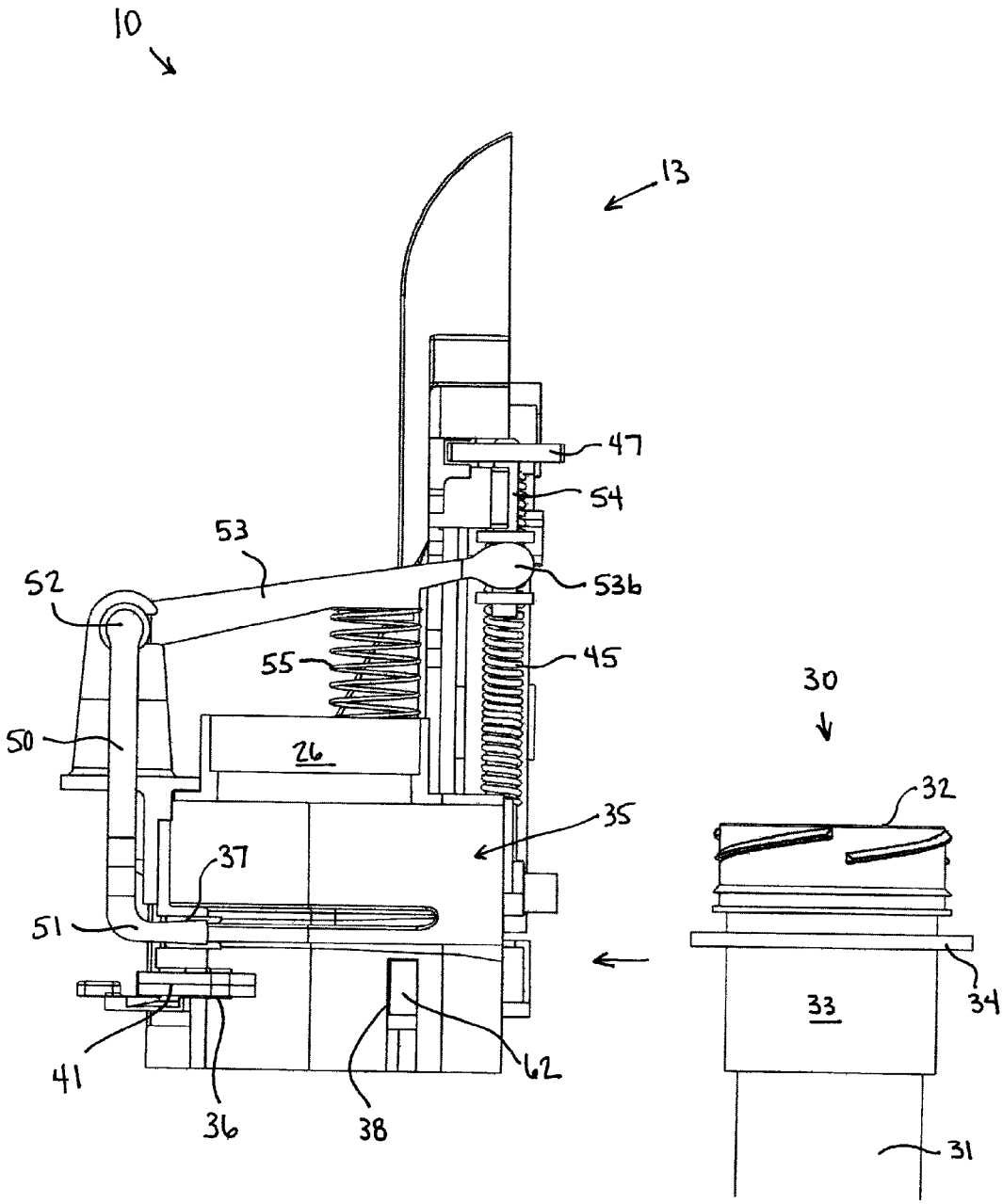
FIG. 11 is a left side cut-away view of the dispensing apparatus showing portions of the dispensing assembly and the locking assembly prior to insertion of the product receptacle.
Figure 12:
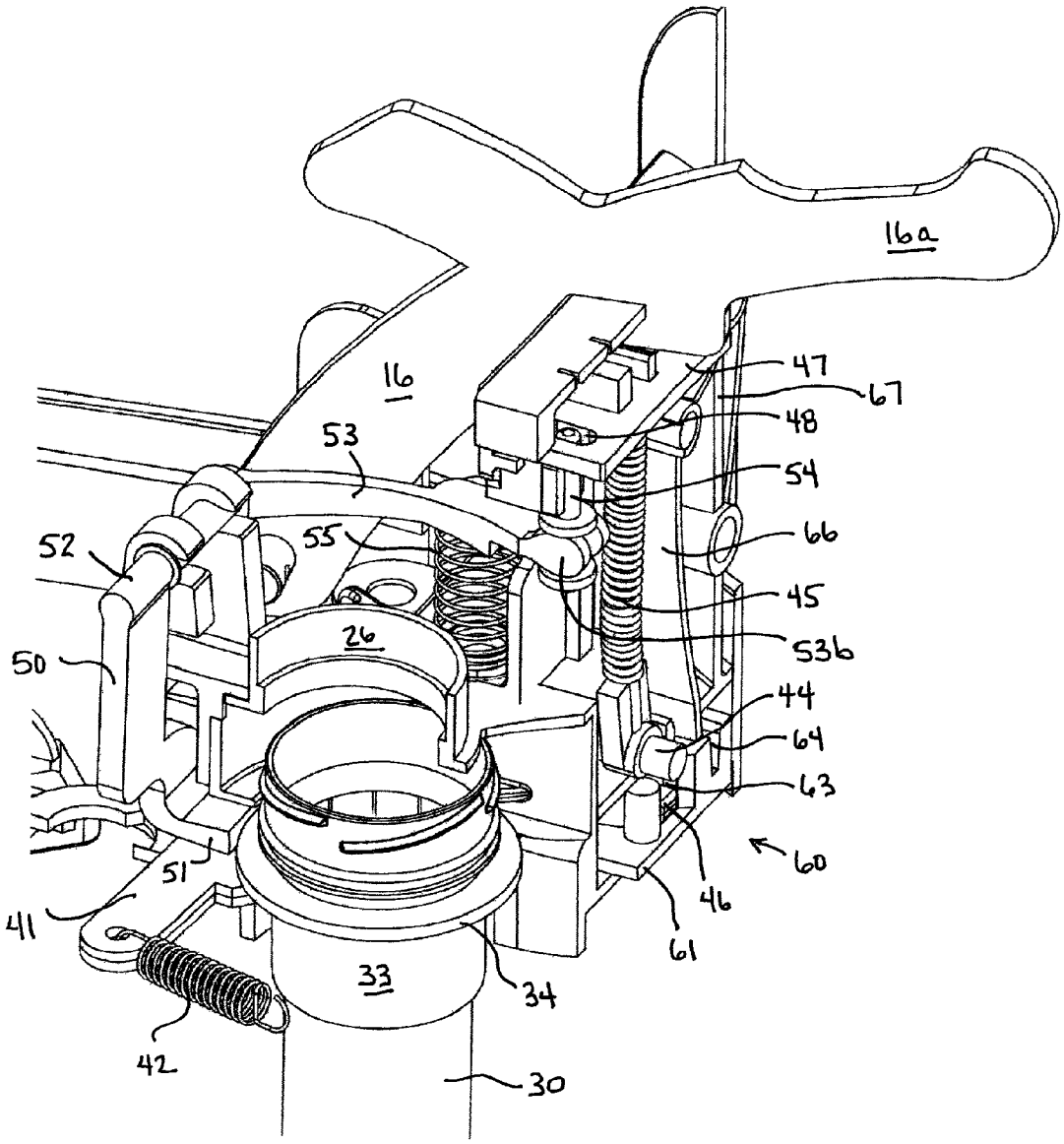
FIG. 12 is a front left cut-away view of the dispensing apparatus showing portions of the dispensing assembly and the locking assembly during insertion of the product receptacle.
Figure 13:
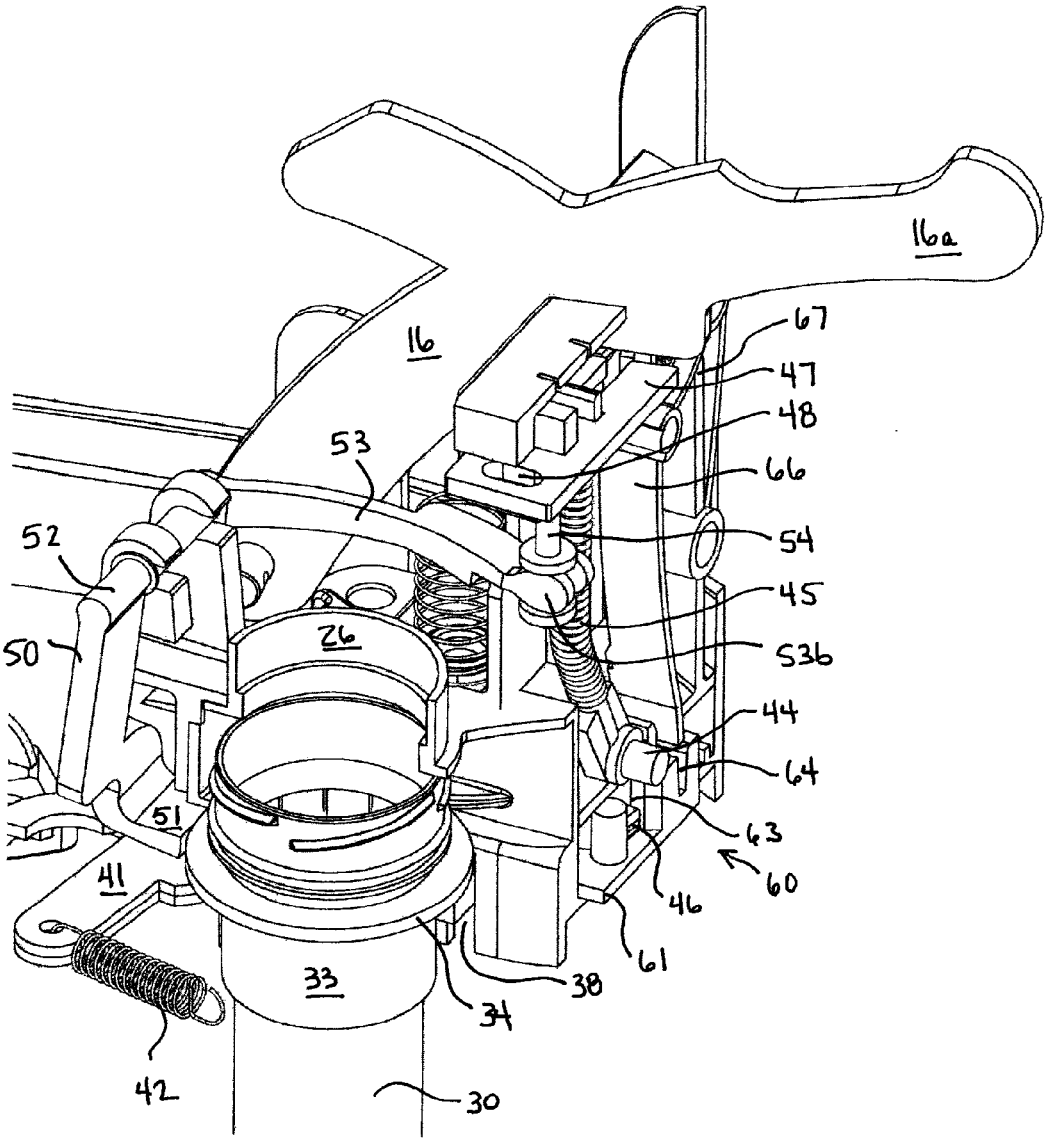
FIG. 13 is a front left cut-away view of the dispensing apparatus showing portions of the dispensing assembly and the locking assembly after complete insertion of the product receptacle.
Figure 14:
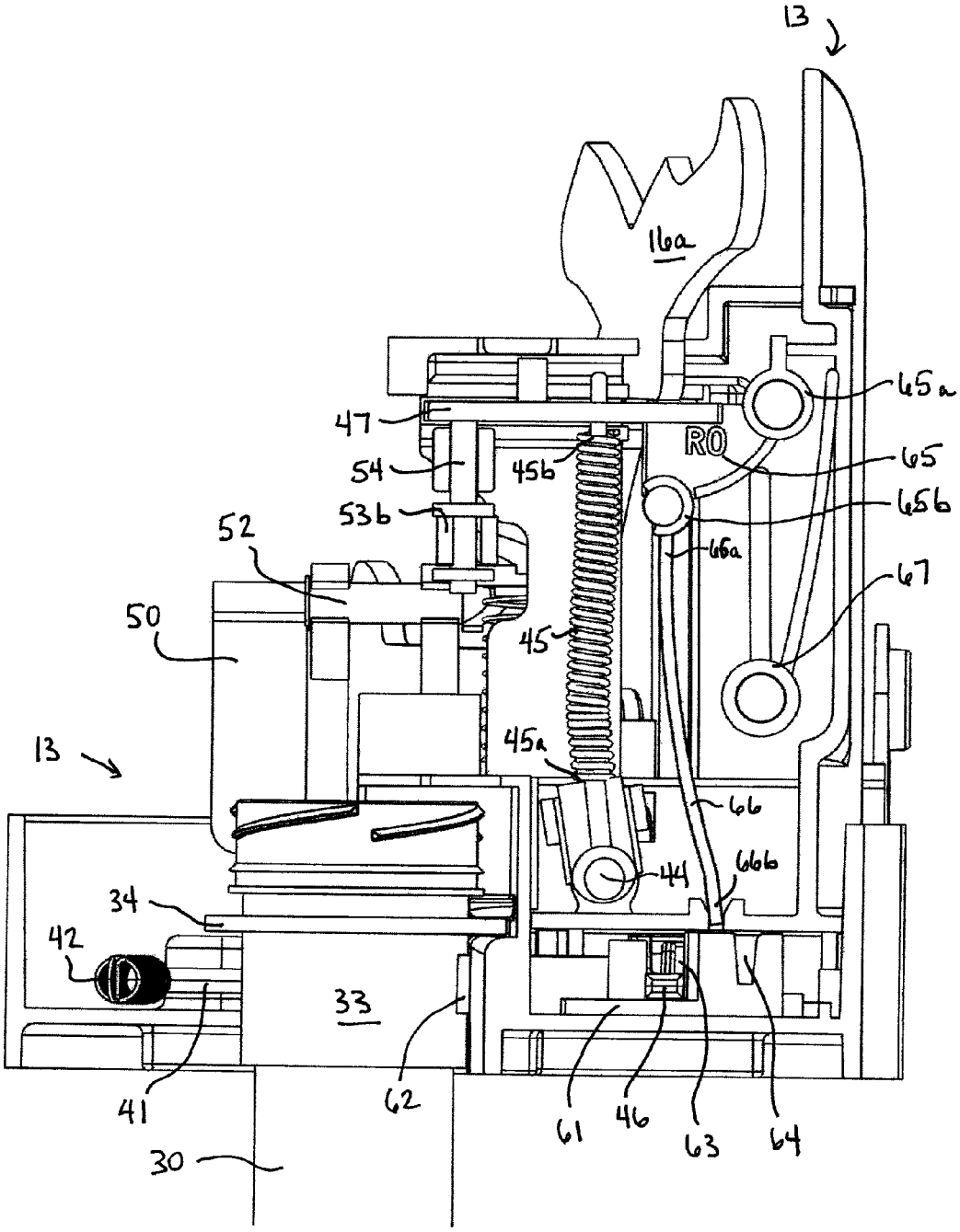
FIG. 14 is a front cut-away view of the dispensing apparatus showing portions of the dispensing assembly and the locking assembly during insertion of the product receptacle.

As lever first end 16*a* is pulled downward, lever second end 16*c* pivots upward and thereby actuates the connecting rod 18 to push piston 17 angularly upward through the piston shaft 19 such that the dispensable product is pushed upward through piston shaft upper portion 19*b* and piston shaft upper end 19*c* and out of door 23, best shown in FIGS. 5-7. After exiting door 23, the product gravity flows down chute 24, through receptacle shaft 26, and into the product receptacle 30 as illustrated by the arrows in FIGS. 6-7. Once the product has been fully dispensed, the lever first end 16*a* is raised back to its home position. The tensioning arm second ends 21*b* of the tensioning assemblies 20 bias the lever distal tips 16*d* downward so that the lever first end 16*a* is urged to return to its raised home position. As the lever first end 16*a* is raised, lever second end 16*c* is pivoted downward thereby lowering piston 17 so that additional dispensable product can gravity feed into the piston shaft upper portion 19*b*. The dispensing cycle can be repeated if desired.

Once the user is finished obtaining product, the lever first end 16*a* must be returned to its raised home position, after which, the cam spring 67 will bias the cam 65 back into its home position and thereby raise the slide lock 66 so that the slide lock second end 66*b* releases the slide plate 61. As the product receptacle 30 is removed from the receptacle receiving area 35, the latch arm spring 42 biases the latch arm second end 41*b* back through slot 36 and the release arm spring 55 biases the release arm first member 51 back through slot 37. As latch arm 41 pivots, first pivot member 43 actuates pivot rod 44 to rotate clockwise so that latch plate 47 is moved back into lever slot 49 so that lever first end 16*a* is secured above latch plate 47. As release arm 50 pivots, release pin 54 is urged upward to engage slot 48 as latch plate 47 slides back into lever slot 49. Further, as latch arm 41 pivots, second pivot member 46 actuates slide plate 61 to move away from receptacle receiving area 35 so that locking tab 62 is withdrawn through slot 38 out of receiving area 35, thereby allowing the product receptacle 30 to be fully removed from the receiving area 35.

The dispensing apparatus is capable of storing and dispensing a variety of solid materials (e.g. rice, nuts, candy, marbles) in varying amounts as desired by the user. The apparatus has a variable storage capacity due to the modular storage containers. Also, while many dispensers utilize gravity to move material from the storage area to the dispensing opening, the current invention lifts the material angularly up and out giving more control over the amount of material dispensed while preventing accidental free flow and waste. Unlike typical dispensers of this type, the current invention requires a special receptacle to be positioned properly within it before dispensing is allowed. This feature is helpful to prevent unauthorized dispensing of the stored materials and reduces waste. Other dispensers are known to clog or bridge the material when attempting to dispense into containers with small openings, however, the current invention is able to dispense materials into containers with small entry openings (e.g. tube, small bag) without clogging or bridging of the material.

While the invention has been shown and described in some detail with reference to a specific exemplary embodiment, there is no intention that the invention be limited to such detail. On the contrary, the invention is intended to include any alternative or equivalent embodiments that fall within the spirit and scope of the invention as described above and as recited in the appended claims.

The invention claimed is:

1. A dispensing apparatus for dispensing a dispensable material, comprising:

a. a container for holding the dispensable material;

b. a housing including an upper surface for supporting said container, a hopper in communication with said container for receiving the dispensable material therefrom, an angularly disposed piston shaft having an increased diameter upper portion in communication with said hopper for receiving the dispensable material therefrom, a spiral chute in communication with said piston shaft upper portion for receiving the dispensable material therefrom, a pivotable door mounted between said piston shaft and said chute wherein said door is biased to a closed position, and a receptacle receiving area in communication with said chute for receiving the dispensable material therefrom;

c. a dispensing assembly including a lever pivotably mounted to said housing wherein said lever has a first end operable by a user and a second end having a distal tip wherein said lever first end is movable within a vertically disposed lever slot, a piston mounted within said piston shaft wherein said lever second end is operably connected to said piston to linearly advance and retract said piston within said piston shaft, and a tensioning arm pivotably mounted to said housing wherein said tensioning arm has a distal end for engaging said distal tip of said lever second end and biasing said lever second end downward;

d. a latch assembly including a latch arm pivotably attached to said housing wherein said latch arm is pivotably biased into said receptacle receiving area through a first aperture, a slidable latch plate having an opening therein wherein said latch plate is operable to slidably block or unblock said lever slot, a first pivotable member operably connected to said latch arm and said latch plate, and a second pivotable member operably connected to said latch arm;

e. a release assembly including a release arm pivotably attached to said housing wherein said release arm is pivotably biased into said receptacle receiving area through a second aperture, and a release pin operably connected to said release arm wherein said release pin is operable to engage or disengage said latch plate opening and wherein said release pin is biased to engage said latch plate opening;

f. a receptacle locking assembly including a cam member pivotably attached to said housing wherein said cam member is biased into said lever slot, a vertically disposed locking member pivotably attached to said cam member, a locking plate slidably attached to said housing wherein said locking plate is operable to slide into said receptacle receiving area through a third aperture, a first notch formed in said locking plate for receiving said latch arm second pivotable member therein, and a second notch formed in said locking plate for receiving a bottom end of said locking member; and g. a receptacle having an annular surface and an annular flange;

h. wherein said receptacle annular flange is operable to engage said release arm and thereby pivot said release arm out of said receptacle receiving area as said receptacle is inserted into said receptacle receiving area, wherein said release arm is operable to disengage said release pin from said latch plate opening as said release arm is pivoted out of said receptacle receiving area;

i. wherein said receptacle annular surface is operable to engage said latch arm and thereby pivot said latch arm out of said receptacle receiving area as said receptacle is inserted into said receptacle receiving area, wherein said latch arm first pivotable member is operable to slide said latch plate to unblock said lever slot as said latch arm is pivoted out of said receptacle receiving area, wherein said latch arm second pivotable member is operable to slide said locking plate into said receptacle receiving area through said third aperture as said latch arm is pivoted out of said receptacle receiving area and thereby prevent said receptacle from being removed from said receiving area;

j. wherein said lever first end is operable to engage said cam member and thereby pivot said cam member out of said lever slot as said lever first end is moved downward through said lever slot, wherein said cam member is operable to urge said locking member bottom end into said second notch as said cam member is pivoted out of said lever slot and thereby prevent said locking plate from being removed from said receiving area;

k. wherein said lever second end is operable to engage said piston and thereby advance said piston through said piston shaft as said lever first end is moved downward through said lever slot, wherein said piston is operable to push the dispensable material from said piston shaft upper portion through said pivotable door and into said chute as said piston is advanced through said piston shaft, wherein the dispensable product gravity flows down said chute and into said receptacle in said receptacle receiving area.

2. A dispensing apparatus according to claim 1, wherein said lever second end is operable to retract said piston back through said piston shaft as said lever first end is moved upward through said lever slot.

3. A dispensing apparatus according to claim 2, wherein said lever first end is operable to disengage from said cam member to allow said cam member to pivot into said lever slot as said lever first end is moved upward through said lever slot, wherein said cam member is operable to urge said locking member bottom end out of said second notch as said cam member pivots into said lever slot.

4. A dispensing apparatus according to claim 3, wherein said receptacle annular surface is operable to disengage from said latch arm to allow said latch arm to pivot into said receptacle receiving area as said receptacle is removed from said receptacle receiving area, wherein said latch arm first pivotable member is operable to slide said latch plate to block said lever slot as said latch arm is pivoted into said receptacle receiving area, wherein said latch arm second pivotable member is operable to slide said locking plate out of said receptacle receiving area through said third aperture as said latch arm is pivoted into said receptacle receiving area.

5. A dispensing apparatus according to claim 4, wherein said receptacle annular flange is operable to disengage from said release arm to allow said release arm to pivot into said receptacle receiving area as said receptacle is removed from said receptacle receiving area, wherein said release arm is operable to urge said release pin into said latch plate opening as said release arm is pivoted into said receptacle receiving area.

6. A dispensing apparatus for dispensing a dispensable material, comprising:

a. a container for holding the dispensable material;

b. a housing including an upper surface for supporting said container, a hopper in communication with said container for receiving the dispensable material therefrom, an angularly disposed piston shaft having an increased diameter upper portion in communication with said hopper for receiving the dispensable material therefrom, a spiral chute in communication with said piston shaft upper portion for receiving the dispensable material therefrom, and a receptacle receiving area in communication with said chute for receiving the dispensable material therefrom;

c. a dispensing assembly including a lever pivotably mounted to said housing wherein said lever has a first end operable by a user and a second end wherein said lever first end is movable within a lever slot, and a piston mounted within said piston shaft wherein said lever second end is operably connected to said piston to advance and retract said piston within said piston shaft;

d. a latch assembly including a latch arm pivotably attached to said housing wherein said latch arm is pivotably biased into said receptacle receiving area through a first aperture, a slidable latch plate having an opening therein wherein said latch plate is operable to slidably block or unblock said lever slot, and a first pivotable member operably connected to said latch arm and said latch plate;

e. a release assembly including a release arm pivotably attached to said housing wherein said release arm is pivotably biased into said receptacle receiving area through a second aperture, and a release pin operably connected to said release arm wherein said release pin is operable to engage or disengage said latch plate opening; and f. a receptacle having an annular surface and an annular flange;

g. wherein said receptacle annular flange is operable to engage said release arm and thereby pivot said release arm out of said receptacle receiving area as said receptacle is inserted into said receptacle receiving area, wherein said release arm is operable to disengage said release pin from said latch plate opening as said release arm is pivoted out of said receptacle receiving area;

h. wherein said receptacle annular surface is operable to engage said latch arm and thereby pivot said latch arm out of said receptacle receiving area as said receptacle is inserted into said receptacle receiving area, wherein said latch arm first pivotable member is operable to slide said latch plate to unblock said lever slot as said latch arm is pivoted out of said receptacle receiving area;

i. wherein said lever second end is operable to engage said piston and thereby advance said piston through said piston shaft as said lever first end is moved downward through said lever slot, wherein said piston is operable to push the dispensable material from said piston shaft upper portion into said chute as said piston is advanced through said piston shaft, wherein the dispensable product gravity flows down said chute and into said receptacle in said receptacle receiving area.

7. A dispensing apparatus according to claim 6, wherein said latch assembly further includes a second pivotable member operably connected to said latch arm.

8. A dispensing apparatus according to claim 7, further comprising a receptacle locking assembly including a cam member pivotably attached to said housing wherein said cam member is biased into said lever slot, a vertically disposed locking member pivotably attached to said cam member, a locking plate slidably attached to said housing wherein said locking plate is operable to slide into said receptacle receiving area through a third aperture, a first notch formed in said locking plate for receiving said latch arm second pivotable member therein, and a second notch formed in said locking plate for receiving a bottom end of said locking member, wherein said latch arm second pivotable member is operable to slide said locking plate into said receptacle receiving area through said third aperture as said latch arm is pivoted out of said receptacle receiving area and thereby prevent said receptacle from being removed from said receiving area.

9. A dispensing apparatus according to claim 8, wherein said lever first end is operable to engage said cam member and thereby pivot said cam member out of said lever slot as said lever first end is moved downward through said lever slot, wherein said cam member is operable to urge said locking member bottom end into said second notch as said cam member is pivoted out of said lever slot and thereby prevent said locking plate from being removed from said receiving area.

10. A dispensing apparatus according to claim 9, wherein said lever second end is operable to retract said piston back through said piston shaft as said lever first end is moved upward through said lever slot.

11. A dispensing apparatus according to claim 10, wherein said lever first end is operable to disengage from said cam member to allow said cam member to pivot into said lever slot as said lever first end is moved upward through said lever slot, wherein said cam member is operable to urge said locking member bottom end out of said second notch as said cam member pivots into said lever slot.

12. A dispensing apparatus according to claim 11, wherein said receptacle annular surface is operable to disengage from said latch arm to allow said latch arm to pivot into said receptacle receiving area as said receptacle is removed from said receptacle receiving area, wherein said latch arm first pivotable member is operable to slide said latch plate to block said lever slot as said latch arm is pivoted into said receptacle receiving area, wherein said latch arm second pivotable member is operable to slide said locking plate out of said receptacle receiving area through said third aperture as said latch arm is pivoted into said receptacle receiving area.

13. A dispensing apparatus according to claim 12, wherein said receptacle annular flange is operable to disengage from said release arm to allow said release arm to pivot into said receptacle receiving area as said receptacle is removed from said receptacle receiving area, wherein said release arm is operable to urge said release pin into said latch plate opening as said release arm is pivoted into said receptacle receiving area.

14. A dispensing apparatus for dispensing a dispensable material, comprising:

a. a container for holding the dispensable material;

b. a housing including an upper surface for supporting said container, a hopper in communication with said container for receiving the dispensable material therefrom, a piston shaft having an upper portion in communication with said hopper for receiving the dispensable material therefrom, a chute in communication with said piston shaft upper portion for receiving the dispensable material therefrom, and a receptacle receiving area in communication with said chute for receiving the dispensable material therefrom;

c. a dispensing assembly including a lever pivotably mounted to said housing wherein said lever has a first end operable by a user and a second end wherein said lever first end is movable within a lever slot, and a piston mounted within said piston shaft wherein said lever second end is operably connected to said piston to advance and retract said piston within said piston shaft;

d. a latch assembly including a latch arm pivotably attached to said housing wherein said latch arm is pivotably biased into said receptacle receiving area, a slidable latch plate having an opening therein wherein said latch plate is operable to slidably block or unblock said lever slot, and a first pivotable member operably connected to said latch arm and said latch plate;

e. a release assembly including a release arm pivotably attached to said housing wherein said release arm is pivotably biased into said receptacle receiving area, and a release pin operably connected to said release arm wherein said release pin is operable to engage or disengage said latch plate opening; and f. a receptacle having a first engagement surface and a second engagement surface;

g. wherein said receptacle first engagement surface is operable to engage said release arm and thereby pivot said release arm out of said receptacle receiving area as said receptacle is inserted into said receptacle receiving area, wherein said release arm is operable to disengage said release pin from said latch plate opening as said release arm is pivoted out of said receptacle receiving area;

h. wherein said receptacle second engagement surface is operable to engage said latch arm and thereby pivot said latch arm out of said receptacle receiving area as said receptacle is inserted into said receptacle receiving area, wherein said latch arm first pivotable member is operable to slide said latch plate to unblock said lever slot as said latch arm is pivoted out of said receptacle receiving area;

i. wherein said lever second end is operable to engage said piston and thereby advance said piston through said piston shaft as said lever first end is moved downward through said lever slot, wherein said piston is operable to push the dispensable material from said piston shaft upper portion into said chute as said piston is advanced through said piston shaft, wherein the dispensable product gravity flows down said chute and into said receptacle in said receptacle receiving area.

15. A dispensing apparatus according to claim 14, wherein said latch assembly further includes a second pivotable member operably connected to said latch arm.

16. A dispensing apparatus according to claim 15, further comprising a receptacle locking assembly including a cam member pivotably attached to said housing wherein said cam member is biased into said lever slot, a vertically disposed locking member pivotably attached to said cam member, a locking plate slidably attached to said housing wherein said locking plate is operable to slide into said receptacle receiving area, a first notch formed in said locking plate for receiving said latch arm second pivotable member therein, and a second notch formed in said locking plate for receiving a bottom end of said locking member, wherein said latch arm second pivotable member is operable to slide said locking plate into said receptacle receiving area as said latch arm is pivoted out of said receptacle receiving area and thereby prevent said receptacle from being removed from said receiving area.

17. A dispensing apparatus according to claim 16, wherein said lever first end is operable to engage said cam member and thereby pivot said cam member out of said lever slot as said lever first end is moved downward through said lever slot, wherein said cam member is operable to urge said locking member bottom end into said second notch as said cam member is pivoted out of said lever slot and thereby prevent said locking plate from being removed from said receiving area.

18. A dispensing apparatus according to claim 17, wherein said lever second end is operable to retract said piston back through said piston shaft as said lever first end is moved upward through said lever slot.

19. A dispensing apparatus according to claim 18, wherein said lever first end is operable to disengage from said cam member to allow said cam member to pivot into said lever slot as said lever first end is moved upward through said lever slot, wherein said cam member is operable to urge said locking member bottom end out of said second notch as said cam member pivots into said lever slot.

20. A dispensing apparatus according to claim 19, wherein said receptacle second engagement surface is operable to disengage from said latch arm to allow said latch arm to pivot into said receptacle receiving area as said receptacle is removed from said receptacle receiving area, wherein said latch arm first pivotable member is operable to slide said latch plate to block said lever slot as said latch arm is pivoted into said receptacle receiving area, wherein said latch arm second pivotable member is operable to slide said locking plate out of said receptacle receiving area as said latch arm is pivoted into said receptacle receiving area, wherein said receptacle first engagement surface is operable to disengage from said release arm to allow said release arm to pivot into said receptacle receiving area as said receptacle is removed from said receptacle receiving area, wherein said release arm is operable to urge said release pin into said latch plate opening as said release arm is pivoted into said receptacle receiving area.

* * * * *